US009311908B2

(12) United States Patent
Wehling et al.

(10) Patent No.: US 9,311,908 B2
(45) Date of Patent: Apr. 12, 2016

(54) DIAPHRAGM AND PROCESS FOR PRODUCING A DIAPHRAGM FOR AN ULTRASONIC TRANSDUCER

(75) Inventors: Hans-Wilhelm Wehling, Heilbronn (DE); Wilhelm Korthals, Wemding (DE); Uwe Kupfernagel, Vaihingen a.d. Enz (DE)

(73) Assignee: VALEO Schalter und Sensoren GmbH, Bietigheim-Bissingen (DE)

( * ) Notice: Subject to any disclaimer, the term of this patent is extended or adjusted under 35 U.S.C. 154(b) by 1013 days.

(21) Appl. No.: 13/383,424

(22) PCT Filed: Jun. 17, 2010

(86) PCT No.: PCT/EP2010/003663

§ 371 (c)(1), (2), (4) Date: Jan. 11, 2012

(87) PCT Pub. No.: WO2011/009513

PCT Pub. Date: Jan. 27, 2011

(65) Prior Publication Data

US 2012/0113758 A1 May 10, 2012

(30) Foreign Application Priority Data

Jul. 23, 2009 (DE) ..... 10 2009 034 418

(51) Int. Cl.
*G10K 9/20* (2006.01)
*G10K 9/122* (2006.01)

(52) U.S. Cl.
CPC . *G10K 9/20* (2013.01); *G10K 9/122* (2013.01)

(58) Field of Classification Search
CPC ..... H04R 17/00; G10K 9/122; G10K 9/20
See application file for complete search history.

(56) References Cited

U.S. PATENT DOCUMENTS

| | | | | |
|---|---|---|---|---|
| 3,555,311 | A | 1/1971 | Weber | |
| 3,578,995 | A * | 5/1971 | Massa | 310/334 |
| 3,638,052 | A * | 1/1972 | Massa | 310/324 |
| 2007/0017807 | A1 * | 1/2007 | Korthals | 204/429 |
| 2009/0041942 | A1 * | 2/2009 | Hayashi et al. | 427/385.5 |
| 2009/0189054 | A1 * | 7/2009 | Campidell et al. | 250/206 |

FOREIGN PATENT DOCUMENTS

| | | | |
|---|---|---|---|
| DE | 102004031310 | A1 | 1/2006 |
| DE | 102006027594 | A1 | 12/2007 |
| EP | 1431957 | A2 | 6/2004 |
| EP | 1796076 | A1 | 6/2007 |
| EP | 1902789 | A1 | 3/2008 |
| WO | 01/61375 | A1 | 8/2001 |
| WO | 02/12027 | A1 | 2/2002 |
| WO | 2005/024451 | A2 | 3/2005 |

OTHER PUBLICATIONS

International Search Report issued in PCT/EP2010/003663, mailed on Oct. 5, 2010, with translation, 6 pages.

* cited by examiner

*Primary Examiner* — Luke Ratcliffe
*Assistant Examiner* — Hovhannes Baghdasaryan
(74) *Attorney, Agent, or Firm* — Osha Liang LLP

(57) ABSTRACT

The invention relates to a diaphragm (1) for an ultrasonic transducer having a diaphragm body (2) which is made of metallic material and is provided on an outer surface region (5; 8) with a coating (10). In order to make it possible for the diaphragm surface to be provided with a particularly damage-resistant coating, the coating (10) has a transparent form such that the surface region (5; 8) of the diaphragm body (2) is visible through the coating (10).

15 Claims, 1 Drawing Sheet

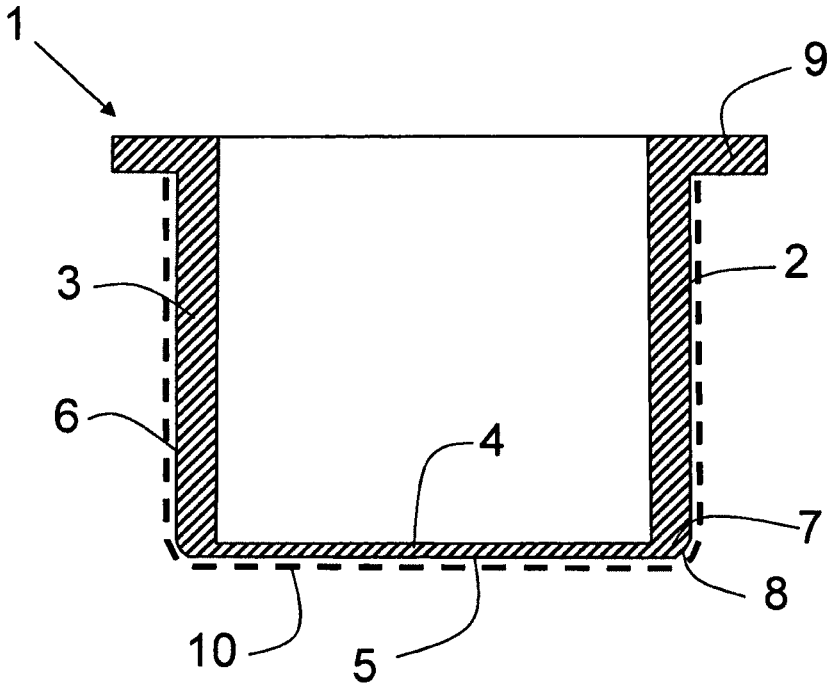
1
9
2
3
6
4
7
8
10
5

DIAPHRAGM AND PROCESS FOR PRODUCING A DIAPHRAGM FOR AN ULTRASONIC TRANSDUCER

The invention relates to a diaphragm and to a process for producing a diaphragm for an ultrasonic transducer of the type mentioned in the preamble of claims 1 and 12, respectively.

Such a diaphragm for an ultrasonic transducer is already known from WO2005/024451 A2. The diaphragm comprises a pot-shaped diaphragm body which is made of aluminium and the base of which forms an oscillating diaphragm surface. The ultrasonic sensor is intended for use in parking assist systems of vehicles and, in the installed state, is fastened to an outer cladding part of the vehicle, with the diaphragm protruding out of the transducer housing, passing through an assembly opening in the cladding part and being arranged with the outer side of the diaphragm surface freely on the outer side of the vehicle.

The outer side of the diaphragm surface thus forms part of the visible outer skin of the vehicle. So that the exposed diaphragm surface blends into the outer skin of the vehicle as aesthetically as possible, the outer side of the diaphragm surface is provided with a coating. In this respect, a dark-coloured powder coating is provided as the coating at least on the exposed diaphragm surface, it being possible for the powder coating to be painted over on the outside in the colour of the vehicle.

Furthermore, EP 1 796 076 B1 discloses a diaphragm for an ultrasonic transducer, the exposed diaphragm surface of which is provided with a chrome/nickel coating. Such a chrome/nickel coating makes it possible to achieve a highly reflective diaphragm surface, as a result of which a visually pleasing integration of the diaphragm is made possible, in particular when assembling the transducer on chrome trim of the vehicle. However, the application of the chrome/nickel coating is relatively complex and costly.

The diaphragm surface exposed on the bumper of the vehicle is exposed to a particularly high degree of environmental influences, such as moisture, electric leakage currents, temperature influences or stone chips, which can lead to the coating being damaged. Such instances of damage can cause the chrome/nickel layer to flake off or chip off; not only does this have a negative effect on the appearance of the diaphragm surface, but it can also entail corrosion of the diaphragm surface. Furthermore, the chrome/nickel layer which has flaked off or chipped off can influence the oscillation behaviour of the diaphragm surface and thereby cause the ultrasonic transducer to make incorrect measurements.

It is an object of the invention to further develop a diaphragm and a process for producing a diaphragm for an ultrasonic transducer of the type mentioned in the preamble of claims 1 and 12, respectively, to the effect that it is possible for the diaphragm surface to be provided with a particularly damage-resistant coating.

This object is achieved according to the invention by the features of claim 1. The dependent claims contain further features which configure the invention in an advantageous manner.

The advantage achieved by the invention is that the coating has a transparent form such that the surface region of the diaphragm body is visible through the coating. The appearance of the surface region is therefore at least largely retained even if the coating is damaged, i.e. regions with a coating which has not been damaged act visually together with regions with a damaged coating or a coating which is no longer present, since an observer always sees the metal surface of the diaphragm body in all regions. As a result, a largely uniform appearance and reflection behaviour of the diaphragm surface are retained even if the coating is damaged.

In contrast to the prior art, the approach according to the invention therefore consists in not concealing the metallic diaphragm surface, but instead making it visible through a transparent coating. The diaphragm surface provided with the transparent coatings here acts visually like a chrome coating, without however having the disadvantages thereof in terms of resistance and corrosion behaviour. If necessary, the hue of the visible diaphragm surface can be adapted to the adjoining outer skin of the vehicle by colouring the transparent coating.

The surface region of the diaphragm body which is visible through the transparent coating preferably has a highly reflective form so as to achieve a visually pleasing, highly reflective appearance of the diaphragm.

A highly reflective appearance can be obtained, in particular, by a polished surface region of the diaphragm body, it being possible for the polished surface region to be produced by a mechanical or electropolishing process.

In order to improve the adhesion of the transparent coating, the surface region of the diaphragm body is preferably degreased and pickled using a wet-chemical pretreatment process. Since the wet-chemical pretreatment is effected after the polishing, it should be ensured that the polished surface region of the diaphragm body is not damaged by the pretreatment and does not become tarnished or dull.

To afford protection against corrosion and for improved adhesion of the transparent coating, the surface region of the diaphragm body can be provided with a passivation layer, the passivation layer preferably being produced in a chrome-free process. In this case, too, it should be ensured that the polished surface does not become tarnished or dull as a result of the chemical treatment.

A transparent layer of paint of an electrically non-conductive material is preferably provided as the coating of the surface region. In order to achieve a particularly uniform and resistant coating, the coating can be in the form of a transparent powder coating, in particular of acrylic powder.

The coating according to the invention is advantageous in particular for diaphragm bodies made of aluminium, since these are particularly susceptible to corrosion. The coated diaphragm body can be used in particular in an ultrasonic distance sensor for vehicles which is usually installed in the bumper region of the vehicle and is therefore exposed to a particularly high degree of environmental influences.

The diaphragm body can have a pot-shaped form and in its base region can form the oscillating diaphragm surface, wherein the coated surface region is arranged on the outer side of the diaphragm surface. Here, the coated surface region preferably encompasses the entire outer side of the diaphragm surface and also at least one adjoining transition region to a lateral surface of the diaphragm body. It is thereby possible to prevent damage from occurring proceeding from the edge of the coating.

An exemplary embodiment of the invention is explained in more detail hereinbelow with reference to a graphic illustration.

In the illustration:

FIG. 1 shows a section through a diaphragm for an ultrasonic transducer.

FIG. 1 shows a section through a diaphragm 1 for an ultrasonic transducer for vehicles. The ultrasonic transducer, which is not shown in more detail, is intended for use as a distance sensor in parking assist systems of motor vehicles and comprises a transducer housing which, in the installed state, is fastened via an associated holder to an outer cladding part, such as for example a bumper, of the automobile. The outer cladding part is formed, in particular, by a trim strip which is integrated in a bumper and has a chrome-plated surface or a surface in chrome optics.

The diaphragm 1 comprises a diaphragm body 2 which overall has a pot-shaped form and has a cylindrical circumferential wall 3 and a base region, which forms an oscillating diaphragm surface 4. The diaphragm surface 4 and the circumferential wall 3 merge into one another at their outer sides 5 and 6 at a transition region 7, the transition region 7 being formed by a radius. Alternatively, however, a transition region 7 with a bevel angle, for example, would also be possible.

The oscillating diaphragm surface 4 is excited to oscillate via a piezo element (not shown) which is arranged, in the installed state, on the inner side of the diaphragm surface 4. A collar 9 is angled circumferentially away from the free end of the cylindrical circumferential wall 3 of the diaphragm body 2. The diaphragm body 2 has been produced from aluminium in one part and has been produced mechanically, in particular by material-removing machining, from a semi-finished product.

When the ultrasonic transducer is in the installed position, the diaphragm 2 protrudes from the transducer housing with the diaphragm surface 4 and a portion of its lateral surface 3, the diaphragm surface 4 passing through a corresponding through-opening in the adjoining outer cladding part of the automobile and, by way of its outer side 5, adjoining the outer side of the outer cladding part approximately flush. The outer side 5 of the diaphragm surface 4 and the outer side 8 of the adjoining transition region 7 thus lie freely on the outer side of the vehicle and form a subregion of the visible outer skin of the vehicle.

The outer sides 5 and 8 of the diaphragm surface 4 and of the transition region 7 each have a polished, highly reflective surface which has been produced by a mechanical polishing process. Furthermore, the outer sides of the lateral surface 6, of the transition region 7 and of the diaphragm surface 4 have been degreased and pickled using a wet-chemical process and surface-treated using a chrome-free passivation process.

The outer sides of the lateral surface 6, the outer side 8 of the transition region 7 and the outer side 5 of the diaphragm surface 4 are provided over their entire surface area with a continuous coating 10 of transparent paint. Here, a single-layer clearcoat is used as the coating 10, the coating 10 having a transparent form such that the polished outer side of the diaphragm body 2 is visible through the coating 10. Here, the coating 10 provided is a powder coating in particular of acrylic paint. In the outer sides 5 and 8 of the diaphragm surface 4 and of the transition region 7, which have been polished to a high reflectivity and are arranged in the visible region when the transducer is mounted, the diaphragm 1 therefore has a highly reflective appearance.

The coating 10 of powder has a different layer thickness in the various surface regions of the diaphragm body 2. On the outer side 5 of the diaphragm surface 4, the coating has a thickness of at least 70 μm, preferably about 100 μm, since this region is exposed to the environmental influences to a particularly high degree when the ultrasonic transducer is mounted. In the transition region 7 and in the region of the lateral surface 6, by contrast, the coating has a thickness of only at least 10-12 μm. The transparent coating 10 of powder is applied directly to the pre-treated surface of the diaphragm body 2 and then forms the outer side of the surface of the diaphragm 1. No further coatings are provided either on the outer side of the coating 10 or between the coating 10 and the outer side 5 and 8 of the diaphragm body 2.

In order to adapt the visual appearance of the diaphragm surface to the adjoining outer cladding part of the vehicle, the powder coating can be coloured continuously, the colouring being transparent such that the surface of the diaphragm body 2 is visible through the coating 10 in the hue of the colouring. The colouring here is obtained by the addition of appropriate dyes to the powder coating.

The process for producing the diaphragm 1 proceeds as follows:

Firstly, the diaphragm body 2 is produced by machining from an aluminium semi-finished product. In this case, a precisely defined thickness of the diaphragm surface 4 is created, such that the diaphragm surface 4 has precisely a predefined resonant frequency after it has been completed. When determining the thickness, it must be borne in mind that material is further removed from the outer side 5 of the diaphragm surface 4 during the subsequent polishing process. The outer side 5 of the diaphragm surface 4 and the outer side 8 of the transition region 7 are then polished to a high reflectivity in order to produce a smooth, highly reflective surface in the visible region of the diaphragm surface. The machining of the diaphragm body 2 is thus completed.

Before painting, the diaphragm body 2 is degreased, pickled and rinsed in a wet-chemical process in various baths. In a subsequent, chrome-free passivation process, the diaphragm surface is then provided with a passivation layer for improved corrosion resistance and paint adhesion. The pretreatment must be configured overall such that, in contrast to conventional picklings and passivations, the highly reflective surfaces 5 and 8 are not impaired.

After the drying step of the pretreatment, the pre-treated diaphragm body 1 is provided with the transparent coating 10 in a powder coating process. To this end, the diaphragm body 2 is firstly inserted into a corresponding receiving frame, from which only the surface regions of the diaphragm body 2 which are to be provided with the coating 10 protrude. In this case, provision is preferably made of a receiving frame which can simultaneously be fitted with a multiplicity of diaphragm bodies 2. A transparent powder coating of acrylic powder is then statically sprayed as a mist onto the surfaces 5, 6 and 8 of the diaphragm body 2 which are to be coated, and is then baked in a heating furnace. After baking, the coating 10 shown in FIG. 1 is then present. When applying the coating 10, it should be ensured that a predefined layer thickness is complied with over the entire region of the diaphragm surface 4, in order to achieve the desired oscillation behaviour of the coated diaphragm surface 4. Furthermore, the layer thickness in the transition region 7 and on the lateral surface 2 must not be below a value of 10-12 μm, so as to ensure that these regions are sufficiently protected.

After the coating 10 has been applied by means of the coating process, the diaphragm 1 can be provided directly, i.e. without the application of further, outer coatings, with a piezo element and installed on the ultrasonic transducer.

The invention claimed is:

1. A diaphragm forming an outer layer covering an ultrasonic transducer, comprising:

a diaphragm body which is made of metallic material and is provided on an outer surface region with a coating, wherein the coating has a transparent form such that the surface region of the diaphragm body is visible through the coating, wherein the transparent coating is applied directly to a pre-treated surface of the diaphragm body, wherein the outer surface region of the diaphragm body has a highly reflective form, wherein the outer surface region of the diaphragm body is polished, and wherein the ultrasonic transducer converts ultrasonic signals from the diaphragm into electric signals.

2. The diaphragm according to claim 1, wherein the surface region of the diaphragm body is pretreated by wet chemical means.

3. The diaphragm according to claim 1, wherein the surface region of the diaphragm body is provided with a passivation layer.

4. The diaphragm according to claim 1, wherein a transparent layer of paint is provided as the coating.

5. The diaphragm according to claim 4, wherein a transparent powder coating is provided as the coating.

6. The diaphragm according to claim 5, wherein a transparent powder coating of acrylic powder is provided.

7. The diaphragm according to claim 1, wherein the diaphragm body is produced from aluminum.

8. The diaphragm according to claim 1, wherein the diaphragm body has a pot-shaped form and in its base region forms an oscillating diaphragm surface, wherein the outer surface region is arranged on the outer side of the oscillating diaphragm surface.

9. The diaphragm according to claim 8, wherein the surface region encompasses the entire outer side of the oscillating diaphragm surface and also an outer side of an adjoining transition region to a lateral surface of the diaphragm body.

10. A method for producing a diaphragm forming an outer layer covering an ultrasonic sensor, comprising:

providing an outer surface region of a diaphragm body made of metallic material with a transparent coating such that the outer surface region of the diaphragm body is visible through the coating, wherein the transparent coating is applied directly to a pre-treated surface of the diaphragm body;

providing the outer surface region of the diaphragm body with a highly reflective form; and polishing the outer surface region of the diaphragm body, and wherein the ultrasonic transducer converts ultrasonic signals from the diaphragm into electric signals.

11. The method according to claim 10, wherein the polishing of the outer surface region of the diaphragm body occurs before the transparent coating is applied.

12. The method according to claim 11, further comprising:

pre-treating the outer surface region of the diaphragm body by wet chemical means after the polishing and before the transparent coating is applied.

13. The method according to claim 10, further comprising providing the outer surface region of the diaphragm body with a passivation layer before the transparent coating is applied.

14. The method according to claim 10, wherein the transparent coating is applied by painting.

15. The method according to claim 10, wherein the transparent coating is applied by powder coating.

* * * * *